United States Patent [19]

Parlatore

[11] Patent Number: 5,022,253

[45] Date of Patent: Jun. 11, 1991

[54] HAND-HELD PUNCH PLIERS

[75] Inventor: Rocco Parlatore, Everett, Mass.

[73] Assignee: Mass-Tex Company, Ltd., Mansfield, Tex.

[21] Appl. No.: 905,764

[22] Filed: Sep. 9, 1986

[51] Int. Cl.[5] ..... B21D 31/02

[52] U.S. Cl. ..... 72/325; 30/363; 30/366; 72/326; 72/409

[58] Field of Search ..... 30/363, 358, 366; 72/325, 326, 409; 29/243.5, 243.52, 268; 7/132, 133

[56] References Cited

U.S. PATENT DOCUMENTS

| | | | |
|---|---|---|---|
| 68,687 | 9/1867 | Beck | 30/363 |
| 764,336 | 7/1904 | Bernard | 30/363 |
| 824,551 | 6/1906 | Levis | 72/409 |
| 3,842,650 | 10/1974 | Hartmeister | 30/363 |
| 3,877,280 | 4/1975 | Cornell | 72/325 |
| 4,291,464 | 9/1981 | Garrett | 30/363 |

OTHER PUBLICATIONS

"Pack a Punch" advertising brochure for HP18 Hole Punch and PL1 Punch Lock by Malco Products, Inc.

Instructions and Parts Lists for No. XX Hand Punch and No. 5 JR. Hand Punch by Roper Whitney Co.

*Primary Examiner*—Frank T. Yost

*Assistant Examiner*—Eugenia A. Jones

*Attorney, Agent, or Firm*—John W. Montgomery

[57] ABSTRACT

A hand-held punch pliers for simultaneously punching and connecting overlapping sheet metal as at the corners of overlapping ceiling tile grids and the like comprising a die handle to which a hollow die is affixed, a punch handle to which a punch is affixed. The punch is sized for insertion along an arcuate path into the die. A joint pivotably connects the die handle to the punch handle such that the die and the punch are moveable in arcuate paths about the joint into and out of punching engagement by manually squeezing and releasing the handles.

2 Claims, 1 Drawing Sheet

HAND-HELD PUNCH PLIERS

BACKGROUND OF THE INVENTION

The invention relates to a punching tool used to punch holes in sheet metal and in particular tools for punching holes in formed sheet metal ceiling tile grid frame work material. A typical grid frame work for a suspended tile ceiling is formed of sheet metal corner angle sections, U channel sections, and T sections which are interconnected by overlapping them and riveting them together. In order to connect the overlapping sheet metal sections, holes are drilled or otherwise formed through which pop rivets may be inserted. These holes must normally be formed at the installation site because it is not usually possible to predict with certainty the locations at which the sections will overlap.

DESCRIPTION OF THE PRIOR ART

Twist drill bits have been used to form these holes. Twist drill bits are not well suited for making holes in thin sheet metal while working overhead as the spinning drill bit grabs and rips the sheet metal when its tip penetrates the thin material. Also metallic filings fall from overhead onto the worker and into the face of the worker.

Hole punches have been found to be useful in the installation of ceiling tile grids. However, the prior art hole punches have fixed jaw widths. This limits the usefulness of the fixed jaw punches in situations where a wide portion of the grid material must be "stradled" such as T sections and U channel sections. Such fixed jaw width punches of the prior art include those known as Malco Products, Inc. Punch No. HP 18, the Roper Whitney Co. No. XX Hand Punch, and the Roper Whitney Co. No. 5 Junior Hand Punch. These punches have fixed jaw widths as a result of structure which holds the punch bit for straight line movement coaxial with the die.

The present invention overcomes the problem of limited jaw width by providing a punch tool which is openable to any required degree to straddle an obstacle while it is closeable to perform the punching operation.

The punch is hand operated so it can be used on site. It thereby overcomes the problem of preforming the holes.

Further, the punched material or metallic plug remains connected to the parent sheet so that when working overhead metal does not fall in the worker's face.

Further, the inventive device overcomes the necessity, in many cases, of inserting a rivet through the hole formed. The material punched is only partially cut such that it remains connected and it is bent over through the opening formed in the parent sheet. Thus in a single operation a hole is punched and the overlapping pieces of sheet metal are connected.

SUMMARY OF THE INVENTION

These and other deficiencies in the prior art are overcome by applicant's inventive hand-held punch pliers for simultaneously punching and connecting overlapping sheet metal such as at the corners of overlapping ceiling tile grids and the like. The hand-held punch pliers comprises a die handle, a hollow die affixed to said die handle, a punch handle, a punch affixed to the punch handle and sized for insertion along an arcuate path into the hollow die, and a single joint for pivotably connecting the die handle to the punch handle such that the die and the punch are movable in arcuate paths about the joint into and out of punching engagement by manually squeezing and releasing the handles.

BRIEF DESCRIPTION OF THE SEVERAL DRAWINGS

The foregoing advantages and construction will be more fully understood with reference to the drawings in which.

DETAILED DESCRIPTION OF THE DRAWINGS

Figures 1, 2, 3, 4, 5, 6:
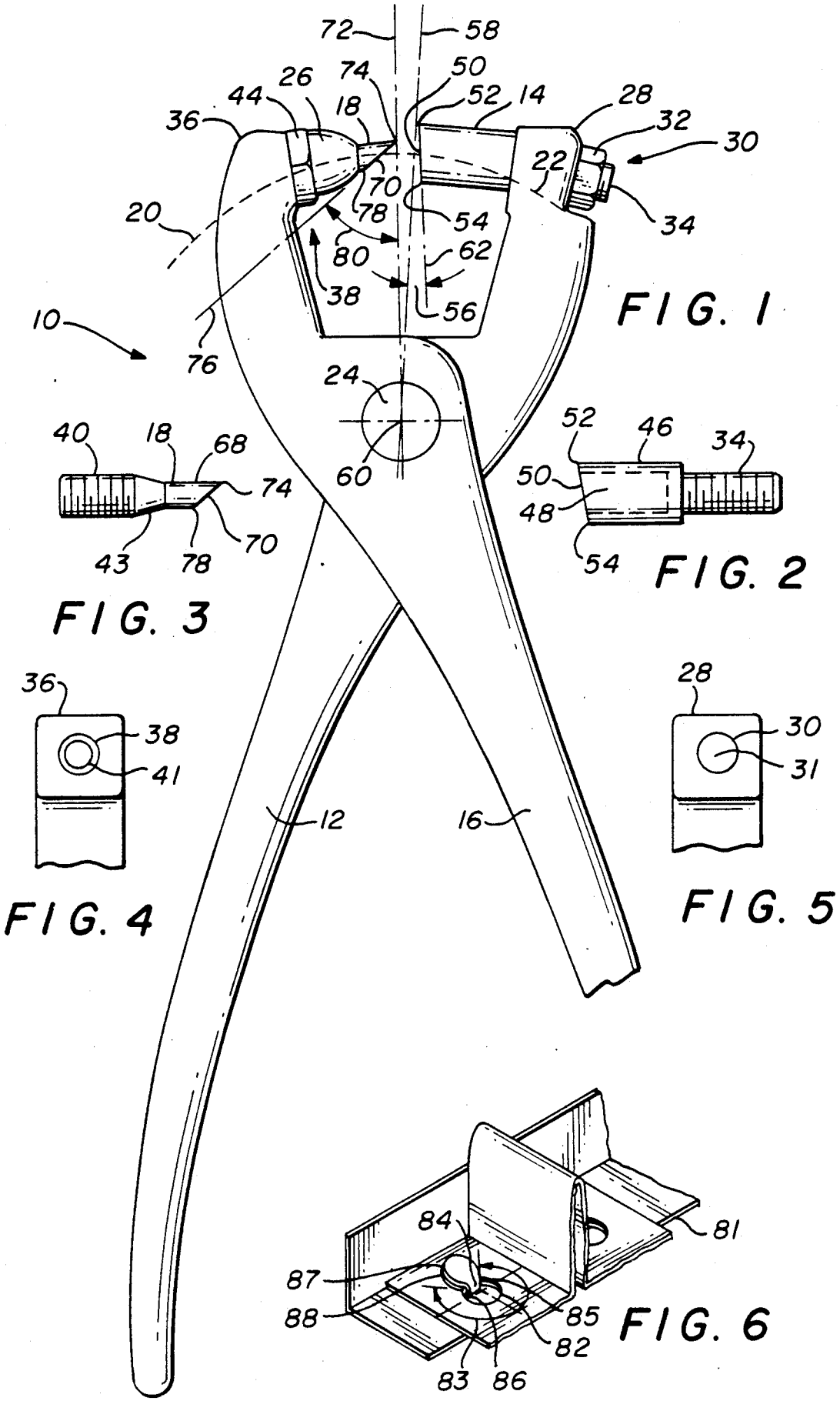
FIG. 1 is a plan view of an embodiment of the hand-held punch pliers.
FIG. 2 is a plan view of one embodiment of the die for use with the hand-held punch pliers.
FIG. 3 is a plan view of one embodiment of the punch for use with the hand-held punch pliers.
FIG. 4 is a partial end view of one embodiment of the punch jaw showing threaded orifice into which the punch may be replaceably attached to the punch jaw.
FIG. 5 is a partial end view of one embodiment of the die jaw showing an orifice through which the die may be replaceably attached to the die jaw.
FIG. 6 is a partial perspective view of a work piece showing a punched hole and crimped connection which results from the operation of hand-held punch pliers according to the present invention.

As described below the present invention may be fully understood with reference being had to FIG. 1 in which hand-held punch pliers generally designated by No. 10. The die handle 12 has a die 14 affixed to it. Preferably die 14 is at least partially hollow hardened steel such as tool steel and is affixed to handle 12 through die jaw 28 at one end thereof. Punch handle 16 has punch 18 affixed to it. Preferably punch 18 is solid hardened steel such as tool steel and is affixed through punch jaw 36 to handle 16. Die handle 12 is pivotably connected to punch handle 16 through joint means 24 such that die 14 is movable about joint 24 in an arcuate path shown in dashed lines as No. 22 on the drawing. Also punch 18 is movable about joint 24 in an arcuate path designated No. 20. The arcuate path 22 traced by die face 50 and the arcuate path 20 traced by punch face 70 are substantially coincident. Punch 18 has an end 68 on which face 70 is formed smaller than hollow portion 48 of die 14 such that punch 18 is insertable into punching engagement with die 14 along an arcuate path 20.

In the preferred embodiment the hand-held punch pliers also advantageously comprises a resilient means 26 which surrounds punch 18 and which extends partially along the length of punch 18 in the direction of die 14. Upon using punch 10 a piece of sheet metal or overlapping pieces of sheet metal are to be positioned between punch 18 and punch 14 such that the sheet metal contacts or is rested against die face 50. Upon manually squeezing handle 12 with respect to handle 16 punch 18 is forced through the sheet metal thereby cutting a hole in the sheet metal of a size substantially equal to the size of punch end 68. The resilient means 26 surrounding punch 18 has a diameter which is larger than the hole which results from the punching operation. Upon squeezing handles 12 and 16 together resilient means 26 compresses against one surface of the sheet metal to be punched. When the handles are released, i.e. when the squeezing pressure on handles 12 and 16 is released, then the resilient means expands substantially returning to its uncompressed position so that it returns the punch partially out of engagement with the punched metal and the die 14. While it will be understood that resilient means such as compression springs could be used, it has been discovered that rubber or another elastic polymer material is preferable to provide cushioning during the punching operation and disengagement action without substantially marring the surface of the sheet material to be punched. This is particularly beneficial where the material to be punched is painted or otherwise finished prior to installation.

Die jaw 28 could be attached to die handle 12 by any known attachment means which makes a rigid connection and which leaves or otherwise provides sufficient space for the required pivot action. In a preferred embodiment die jaw 28 is integrally formed at the end of die handle 12 as by machining, forging, stamping or otherwise forming the handle and jaw from a single piece of suitable metal. Preferably a steel which can be hardened by heat treatment is used. Likewise punch jaw 36 may be attached in any known manner but is preferably integrally formed at the end of the punch handle. In one embodiment as shown in FIGS. 1 and 5 means 30 is provided for connecting die 14 to die jaw 28, it being understood that this connection could also be made by integrally forming die 14 at the end of die jaw 28. Similarly shown in FIGS. 1 and 4 is means 38 for connecting punch 18 to punch jaw 36 which means for connection could be continuous material integrally forming punch 18 at the end of punch jaw 36.

With reference to FIG. 2 and FIG. 1 die 14 in the preferred embodiment comprises a tubular die body having an open end 48 sized for receiving punch 18 as it is moved in arcuate path 20 about joint 24. A die base 34 is provided through which die 14 may be replaceably connected to die jaw 28 as shown in the preferred embodiment die base 34 may be a threaded stud. Alternatively die base 34 may be a threaded tube or any other suitable fastening means affixed to tube body 46.

As may be seen with reference to FIG. 5 means 30 for attaching die 14 to die jaw 28 also includes, in the embodiment shown, an orifice 31 is formed in die jaw 28 through which base portion 34 is inserted for connection. Nut 32 which may be a lock nut 32 or any other suitable fastener is further included to make a rigid connection.

Similarly with reference to FIG. 2 and FIG. 1, punch 18 may be connected to punch jaw 36 through means 38 which means 38 may consist of punch base portion 40 and orifice 41. In the preferred embodiment base portion 40 and orifice 41 are correspondingly threaded. Also lock nut 44 may be provided for additional rigidity. Further with reference to FIG. 3 punch 18 may be provided with a tapered middle portion 43 so that the threaded base portion 40 may be larger than the punch end 68 and for additionally retaining resilient means 26 and also for tapering or beveling the punched portion if sufficient squeezing force is applied to substantially compress resilient means 26.

To obtain simultaneous punching and connecting of overlapping pieces 87 and 88 of FIG. 6 of sheet metal 81 it has been found that, by constructing of the punch pliers in accordance with the present invention for arcuate movement of the punch 18 with respect to the die 14 and by providing a punch 18 and a die 14 which are sized so that the punch may move in an arcuate path into punching engagement, only a portion 82 of the sheet metal 81 is actually cut and the connected portion 84 of the metal is bent by the arcuate action of the punch with respect to the die. Thus, a connecting tab 87 is formed from the sheet metal 81, it remains securely connected to the parent sheet metal 81 and it is inserted through the punched hole 82 simultaneously with the punching. It has been found that, for example, an inside diameter of tubular die body between ¼ of an inch and 5/16ths of an inch (0.64 centimeters and 0.79 centimeters) and an outside diameter of the punch end 68 of ⅛ of an inch to 3/16ths of an inch (0.32 centimeters to 0.48 centimeters) where the depth of the tubular opening 48 is less than ½ of an inch and the length of the die body is likewise less than ½ of an inch, results in sufficient clearance for punch 18 to be fully inserted into tubular die 14 to thereby complete the bending action on the attached partially cut sheet metal 84.

It has also been found that it is beneficial to form the die face at an angle in a range of about 0° to 10° as measured between a first imaginary line, shown in FIG. 1 as line 58, drawn through the center 60 of joint 24 and a radially outwardmost contact point 52 on die face 50 and an imaginary line, shown in FIG. 1 as line 62, which passes through the outermost point of contact 52 on the die face 50 and through a radially inwardmost point of contact 54 on die face 50. Positive degrees greater than zero results in a gap between the inwardmost point of contact 54 and the first imaginary line 58.

The preferred embodiment of punch 18 according to the present invention includes a punch body end 68 which has a solid cylindrical shape. A face 70 is formed at punch end 68 for making as shown in FIG. 6 a semicircular shaped cut 82 in the sheet metal 81 to be punched and which semicircle 82 is more than 180° but less than 360° as demonstrated by arrow 83 and for bending the uncut sheet metal 84 substantially at an imaginary cord on the uncut sheet metal 84 between the ends 85 and 86 of the semicircular shaped cut 82. It has been found that one means of achieving a punch face which is designed for achieving the specified results in conjunction with the structure of the hand-held punch tool of the present invention is to form a punch face which is substantially flat or planar at an angle in the range of about 15° to 75° as measured between a third imaginary line 72 drawn through the center 60 of joint 24 and a radially outwardmost point 74 on punch face 70 and a fourth imaginary line 76 on punch face 70 which passes through the radially outwardmost point 74 and through a radially inwardmost point 78 on the punch face. Positive angular degrees as used herein results in a gap between the radially inwardmost point 78 and the third imaginary line 72. Through experimentation it has been found that good results are obtained where angle 56 is about 5° and angle 80 is about 50°.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A hand-held punch pliers for simultaneously punching and connecting overlapping sheet metal such as at the corners of overlapping ceiling tile grids comprising:

a die handle;

a hollow die affixed to said die handle;

a punch handle;

a punch affixed to said punch handle and sized for insertion along an arcuate path into said hollow die;

a joint means for pivotably connecting said die handle to said punch handle such that said die and punch are movable in arcuate paths about said joint into and out of punching engagement by manually squeezing and releasing said handles;

a die jaw integrally formed at one end of said die handle;

means for connecting said die to said die jaw;

a punch jaw integrally formed at one end of said punch handle; and means for connecting said punch to said punch jaw;

wherein said hollow die comprises:

a tubular die body having an open die end sized for receiving said punch as it is moved in said arcuate path about said joint;

a die base portion through which said die is replaceably connected to said die jaw; and a die face formed around said open end of said tubular die body toward said punch for abutment against said sheet metal being punched and having a radially outwardmost point of contact and a radially inwardmost point of contact;

wherein said die face is formed at an angle in the range of about zero to ten degrees as measured between a first imaginary line drawn through the center of said joint and said radially outwardmost point on said die face and a second imaginary line which passes through said outwardmost point of contact on said die face and through said radially inwardmost point of contact on said die face where a ten degree angle results in a gap between said inwardmost point of contact and said first imaginary line;

wherein said punch comprises:

solid cylindrical punch body having a punch end corresponding sized smaller than said tubular die body portion for non-binding entry into said die as it is moved in said arcuate path about said joint;

a punch base portion for replaceably attaching said punch to said punch jaw; and a face formed at said punch end for making a semicircular shaped cut in said sheet metal to be punched which semicircle is more than 180° but less than 360° and for bending the sheet metal plug formed by said cut substantially at an imaginary cord on the uncut sheet metal between the ends of said semicircular shaped cut.

2. A hand-held punch pliers as in claim 1 wherein said punch face is formed substantially flat at an angle in the range of about fifteen to seventy-five degrees as measured between a third imaginary line drawn through the center of said joint and a radially outwardmost point on said punch face and a fourth imaginary line on said punch face which passes through said radially outwardmost point on said face and through a radially inwardmost point on said punch face with a gap between said radially inwardmost point and said third imaginary line.

* * * * *